US005520550A

United States Patent [19]

Okabe

[11] Patent Number: 5,520,550

[45] Date of Patent: May 28, 1996

[54] CONNECTOR

[75] Inventor: Toshiaki Okabe, Shizuoka, Japan

[73] Assignee: Yazaki Corporation, Tokyo, Japan

[21] Appl. No.: 247,557

[22] Filed: May 23, 1994

[30] Foreign Application Priority Data

May 21, 1993 [JP] Japan ..... 5-031570 U

[51] Int. Cl.[6] ..... H01R 4/24

[52] U.S. Cl. ..... 439/404; 439/452; 439/456

[58] Field of Search ..... 439/395–405, 439/417–419, 717, 456, 733, 460, 452, 463

[56] References Cited

U.S. PATENT DOCUMENTS

| | | | |
|---|---|---|---|
| 4,099,822 | 7/1978 | Carlisle et al. | 439/405 |
| 4,723,915 | 2/1988 | Gentry | 439/417 |
| 4,917,629 | 4/1990 | Matsuzaki et al. | 439/405 |
| 5,122,077 | 6/1992 | Mayima et al. | 439/717 |
| 5,286,225 | 2/1994 | Tsuji | 439/717 |

*Primary Examiner*—David L. Pirlot

*Attorney, Agent, or Firm*—Sughrue, Mion, Zinn, Macpeak & Seas

[57] ABSTRACT

The present connector has a structure which makes it possible to execute a step of mounting a wire holder serving also as a cover member to a housing main body and a step of connecting electrical wires to their respective pressure contact terminals in one operation to simplify the assembly thereof and is thus suitable for mass production. A housing main body supports the pressure contact edges of the pressure contact terminals in an upwardly bent position with respect to the male tabs of the pressure contact terminals. A wire holder holds a plurality of electric wires provisionally in such a manner that the wires can be pressure contacted with their respective pressure contact edges, and serves also as a cover member to close the upper opening of the housing main body, through which opening the pressure contact edges are exposed. By mounting the wire holder to the housing main body, the wires can be connected to the pressure contact terminals. Also, the wires are previously bent and provisionally held by the wire holder and a spacer cooperable with the wire holder to thereby prevent the wires from being removed backwardly.

9 Claims, 7 Drawing Sheets

CONNECTOR

BACKGROUND OF THE INVENTION

1. Field of the Invention

The present invention relates to a connector which stores a plurality of pressure contact terminals for connection of electric wires in a housing main body and connects a partner connector with the pressure contact terminals in an electrically energizable manner and, in particular, to such a connector which is improved in its assembling operation.

2. Description of the Prior Art

A conventional connector that stores a plurality of pressure contact terminals is shown in FIGS. 11 and 12. Conventional connector 1 has a multi-stage structure which includes a connector main body 2 formed of synthetic resin into one united piece, a cover member 3, and a plurality of pressure contact terminals (connector terminals) 4 respectively fixed to the connector main body 2. In a lower surface of the connector main body 2, there is formed an opening 5 into which is fitted a partner connector (not shown). In the upper surfaces of the connector main body 2, a plurality of pressure contact terminals 4 are fixed to three stages of stepped portions 6 formed in such a manner that the terminals 4 project out from the stepped portions 6.

Each pressure contact terminal 4 includes a pressure contact edge 4a in one end portion thereof, while the other end portion of the pressure contact terminal 4 extends into the opening 5 to provide a connecting terminal **4*b* to be connected with another connector acting as its fitting partner. When the pressure contact terminals 4 are connected with electric wires 7 respectively, the electric wires 7 integrally with their respective coatings are pushed into the pressure contact edges 4*a*. As a result, the pressure contact edges 4*a* cut into the coatings and then contact the cores of the wires, so that the pressure contact terminals 4 can be connected with the electric wires 7 in an electrically energizable manner. Therefore, if another connector is fitted into the opening 5, then this connector can be connected with the electric wires 7 through the connector 1**.

The connector main body 2 includes a plurality of securing projections 8 provided in its two side surfaces, while the cover member 3 includes securing holes 9 formed in the two side surfaces thereof, corresponding to the securing projections 8. After the electric wires 7 are connected with the pressure contact edges **4*a*, the connector main body 1 is covered with the cover member 3 and the securing projections 8 are secured to the securing holes 9** to unite them into one integral member.

In the above conventional connector, the electric wires 7 can be connected to the pressure contact terminals 4 in an electrically energizable manner by merely pushing the electric wires 7 into the pressure contact edges **4*a*; that is, peeling off the insulation coverings is not necessary. However, if a pulling force is applied to the electric wire in a direction to remove it backwardly, then the wire 7 is removed from the pressure contact edge 4*a*** relatively easily; that is, the connector has a weak electric wire holding force.

In Japanese Utility Model Publication No. 4-136869 of Heisei, a pressure contact connector possesses a terminal storage chamber disposed in parallel to a housing, the terminal storage chamber having an upper surface opening. By closing the upper surface opening with a cover, projections disposed to project downwardly from the rear end of the cover prevent their respective wires from being moved back and forth between the lower surface rear end edge of the terminal storage chamber by bending the electric wires. Thus, the electric wires cannot be easily pulled out. However, in this pressure contact connector, because a step of connecting the electric wires to their respective pressure contact terminals is executed separately from a step of mounting the cover on the housing, the assembly connector is complicated, which provides an obstacle to mass production.

SUMMARY OF THE INVENTION

It is an object of the present invention to provide a connector in which the electric wires cannot be easily pulled out from their respective pressure contact terminals which can be mass-produced without difficulty.

In attaining the above object, according to the invention, there is provided a connector which houses a plurality of pressure contact terminals and connects the pressure contact terminals with a partner connector in an electrically energizable manner, the connector comprising a housing main body for storing the pressure contact terminals in parallel to one another, the housing main body being opened in the upper surface thereof to be able to expose the pressure contact terminals in part; a wire holder secured to the housing main body for serving as a cover member to close the opened upper surface and also for holding provisionally a plurality of electric wires; and a bending means cooperable with the wire holder to bend the electric wires, wherein the wire holder is secured to the housing main body to be able to pressure-insert the electric wires into their respective pressure contact terminals.

The wire holder is arranged such that it can be mounted on the housing main body while the electric wires are being held provisionally and also the pressure contact terminals are respectively disposed such that the pressure contact edges thereof face the opened upper surface of the housing main body. This structure makes it possible to pressure-insert the electric wires into their respective pressure contact edges by means of a step of securing the wire holder to the housing main body.

Also, according to the invention, the electric wires are provisionally held by the wire holder in such a manner that they are previously bent by the bending means, or the electric wires are bent by a step of mounting the wire holder onto the housing main body so that the wires are prevented from being removed backwardly against a pulling force applied thereto. This improves the ease of assembling of the connector to a great extent.

BRIEF DESCRIPTION OF THE DRAWINGS

The present invention is illustrated in the following drawings, in which.

DETAILED DESCRIPTION OF THE PREFERRED EMBODIMENTS

Figure 1:
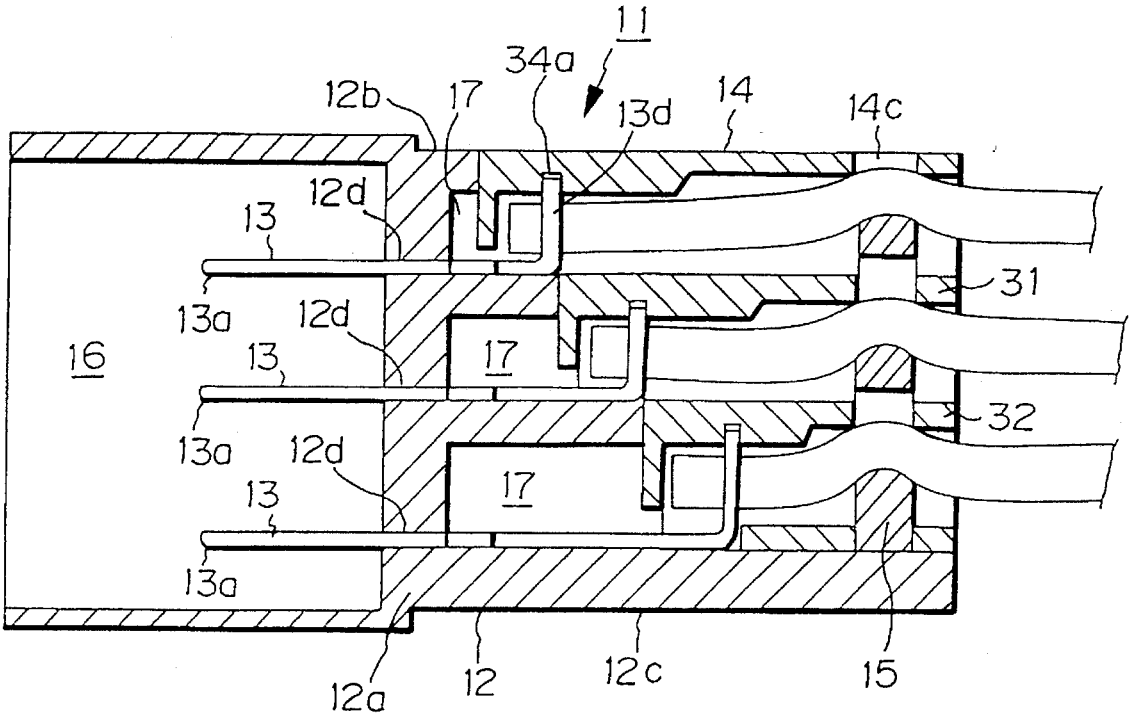
FIG. 1 is a section view of a multi-stage connector which is a first embodiment according to the invention.

Description will be given below of a first embodiment of a connector according to the invention with reference to FIGS. 1 to 6. In describing the first embodiment, description will be given first of the internal structure of the connector, the shapes of the pressure contact terminals, and the engagement relationship between the wire holder and spacer. Afterwards, description will be given of the structure and operation of the connector according to the order of the assembling steps thereof.

Multi-stage connector 11 includes a housing main body 12, a plurality of pressure contact terminals 13, a wire holder 14 and a spacer. The housing main body holds the pressure contact terminals 13 and each terminal 13 includes a male tab 13*a* which serves as an electric contact portion of the terminal. The male tab 13*a* is projected into an opening 16 which is formed in one side portion of the housing main body 12 and is used for fitting a partner connector. Further, there are provided terminal storage chambers which are used to store their respective pressure contact terminals. In the illustrated embodiment, the storage chambers are arranged vertically in three stages within the housing main body 12, while five storage chambers are arranged horizontally in each stage. However, it should be noted that the number of stages and the number of terminal storage chambers are not limited to the illustrated embodiment.

Figure 2:
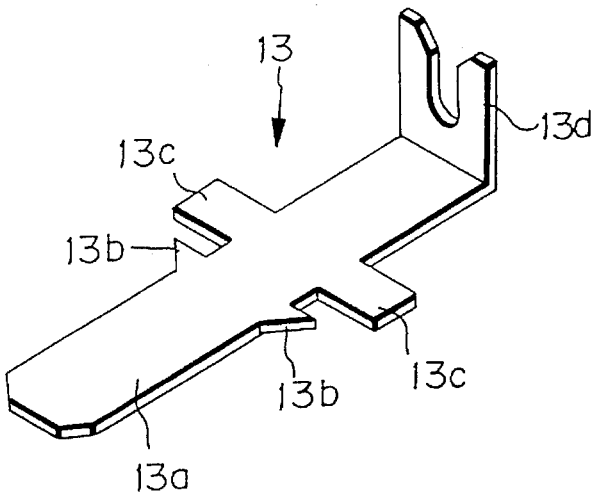
FIG. 2 is a perspective view of a pressure contact terminal.
Figure 3:
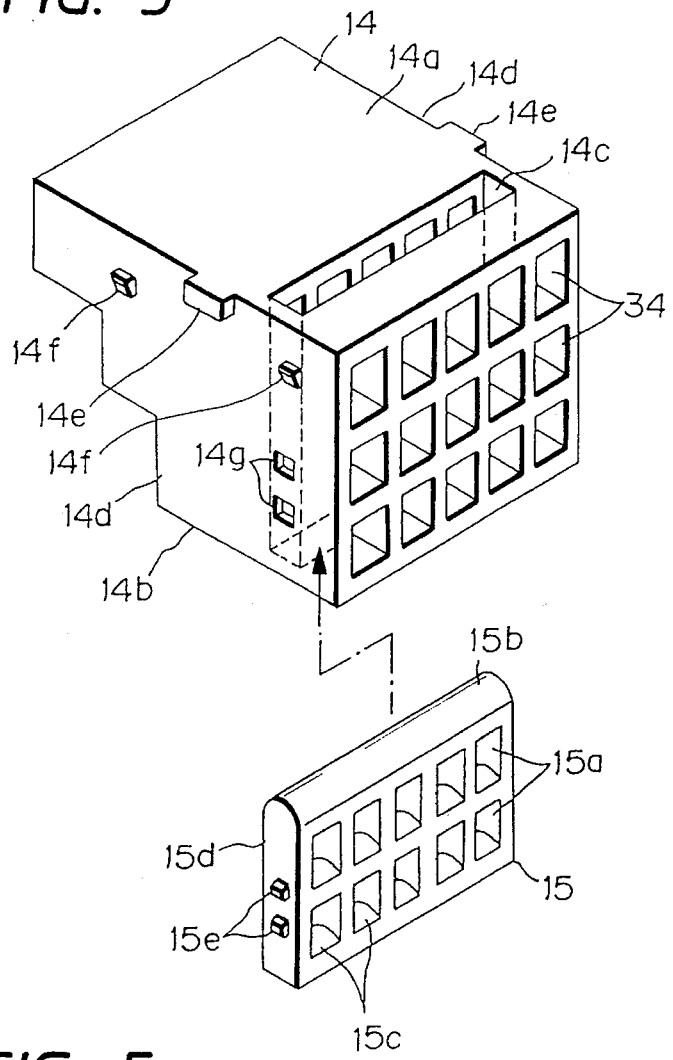
FIG. 3 is a perspective view of a wire holder and a spacer, showing a state in which they are separated.

The pressure contact terminal 13, as shown in FIG. 2, in the first embodiment, consists of a male-type terminal which includes a male tab 13*a*, two housing pressure insertion portions 13*b*, two stoppers 13*c*, and a pressure contact edge 13*d*. The pressure contact terminal 13 is formed by stamping it out from a flat metal plate and the pressure contact edge 13*d* for connection of an electric wire is bent upwardly at right angles with respect to the male tab 13*a* including the stoppers 13*c*.

Each housing pressure insertion portion 13*b* is formed in a triangular shape which makes it easier to pressure-insert the pressure contact terminal 13 into a partition wall 12*a* provided in the housing main body 12. The stopper 13*c* is formed in such a shape which can restrict the pressure contact terminal 13 to a given position when it is contacted with the partition wall 12*a*. The pressure contact terminals 13 consist of three kinds of terminals which are different in length from one another. Therefore, when the pressure contact terminals 13 are stored in their respective terminal storage chambers 17 (which will be described later) and the respective leading ends of the male tabs 13*a* projecting into the opening 16 are arranged equally in a uniform surface, the pressure contact edges 13*d* provided at the respective rear ends thereof are shifted in position sequentially in the longitudinal direction of the connector.

The interior of the housing main body 12 is formed of a rectangular box, while the substantially central portion of the interior of the housing main body 12 is separated by the partition wall 12*a*. Accordingly, the housing main body 12 interior is opened from one side portion thereof, which corresponds to the front surface of the connector, to the partition wall 12*a* to thereby form an opening 16 into which the partner connector can be fitted. On the other hand, in the connector rear portion side of the housing interior with the partition wall 12*a* as a boundary, the upper surface and rear end face are removed, except for a top plate 12*b* raised slightly, to thereby form an opening.

Also, on the connector rear side, within the housing main body 12, there are provided two partition plates 31 and 32 which are respectively formed in a flat plate shape and are used to divide the portion of the main body 12 existing between the top plate 12*b* and bottom plate 12*c* into three equal parts. Further, a plurality of partition members 33 are disposed vertically at given distances on the partition plates 31, 32 and bottom plate 12*c* to provide a plurality of terminal storage chambers 17. In the partition wall 12*a* for closing the leading ends of the respective terminal storage chambers 17, there are formed a plurality of terminal insertion through holes 12*d* through which the pressure contact terminals 13 can be inserted respectively. Moreover, the partition plates 31, 32 are extended respectively beyond the partition wall 12*a* but in different lengths, so that the rear end portions of the respective terminal storage chambers 17 of the respective stages are respectively arranged as the stepped portions. In this structure, when the pressure contact terminals 13 corresponding to the respective stages but different in size are stored respectively in the terminal storage chambers 17 of the respective stages, the pressure contact edges 13*d* thereof are projected toward the upper surface opening as well as are exposed in a manner to face the upper surface opening, respectively.

The wire holder 14 is also used as a cover member to close the upper surface opening of the housing main body 12 and is arranged as a block which has an opening 14*h* in a portion of the lower section thereof. Wire holder 14 is formed in a stepped structure corresponding to the respective stepped stages of the housing main body 12, and is fittable between the two side plates 12*e* of the housing main body 12. Wire holder 14 includes wire insertion portions 34 which are respectively opened so as to correspond to the three stages and five horizontal rows of the terminal storage chambers 17, and further includes a spacer insertion portion 14*c* which extends through between the holder top surface 14*a* and holder bottom surface 14*b*.

Figure 5:
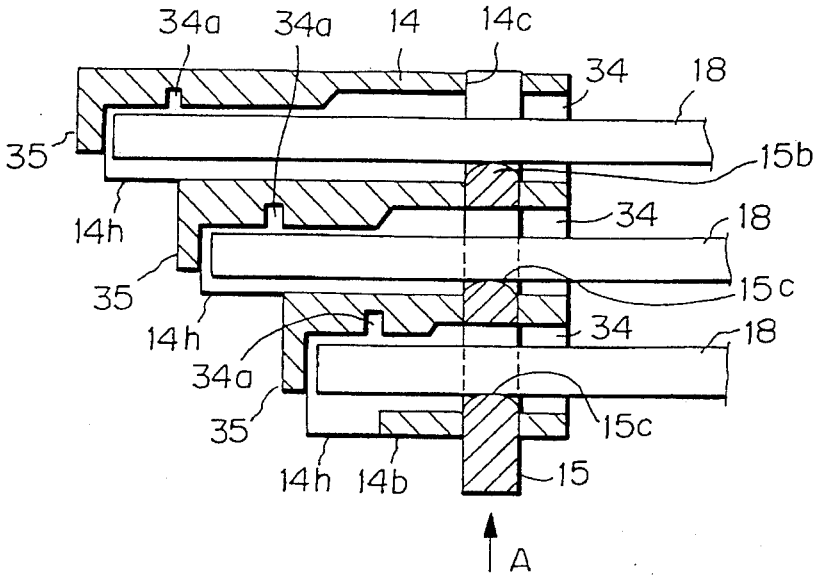
FIG. 5 is a longitudinal section view of the wire holder and spacer, showing a state in which they are fitted with each other.

As best illustrated in FIG. 5, on the opening end faces of the wire insertion portions 34 facing the terminal storage chambers 17, vertical walls 35 are provided which are respectively suspended from the wire insertion portion opening end faces and are used to close the opening end faces in part for stopping the electric wires. Further, in the upper inner wall surfaces of the wire insertion portions 34, there are opened up securing holes 34*a* which are respectively formed so as to be able to secure therein the projecting end portions of the pressure contact edges 13*d* respectively bent on and from the terminal storage chambers 17. In the illustrated embodiment, vertical walls 35 are formed integrally with the wire insertion portions 34. However, the invention is not limited to this structure but, for example, the vertical walls 35 may be formed of separate members and then may be mounted to the opening end faces of the wire insertion portions 34 by bonding or the like.

Regarding a structure for securing the wire holder 14 to the housing main body 12, two securing holes 12*f* are provided in each of the two side plates 12*e* of the housing main body 12 and a cutaway portion 12*g* is formed in the upper edge of each of the side plates 12*e*. Correspondingly, the wire holder 14 includes on each of the two side surfaces 14*d* thereof a projection 14*e* which is fittable with the cutaway portion 12*g*, and two engaging projections 14*f* which can be secured to the respective securing holes 12*f* of the housing main body 12.

The spacer 15 is formed substantially in a flat plate member having a shape fittable into the spacer insertion portion 14*c* of the wire holder 14 and also includes opening windows 15*a* which are provided in the plate surface thereof in such a manner that they correspond to the two stages and five rows of the wire holder 14. Also, the upper edge portion 15*b* of the spacer 15 and the bottom edge portions 15*c* of the respective opening windows 15*a* thereof are respectively formed in a curved surface shape. Further, the spacer 15 includes in each of the two side surface portions 15*d* thereof two spacer securing projections 15*e* which are arranged vertically. Thus, if the spacer securing projections 15*e* are engaged into their corresponding securing holes 14*g* respectively opened up in the two side surfaces 14*d* of the wire holder 14, then the spacer 15 can be held by the wire holder 15 and can be restricted to a given position.

Figure 4:
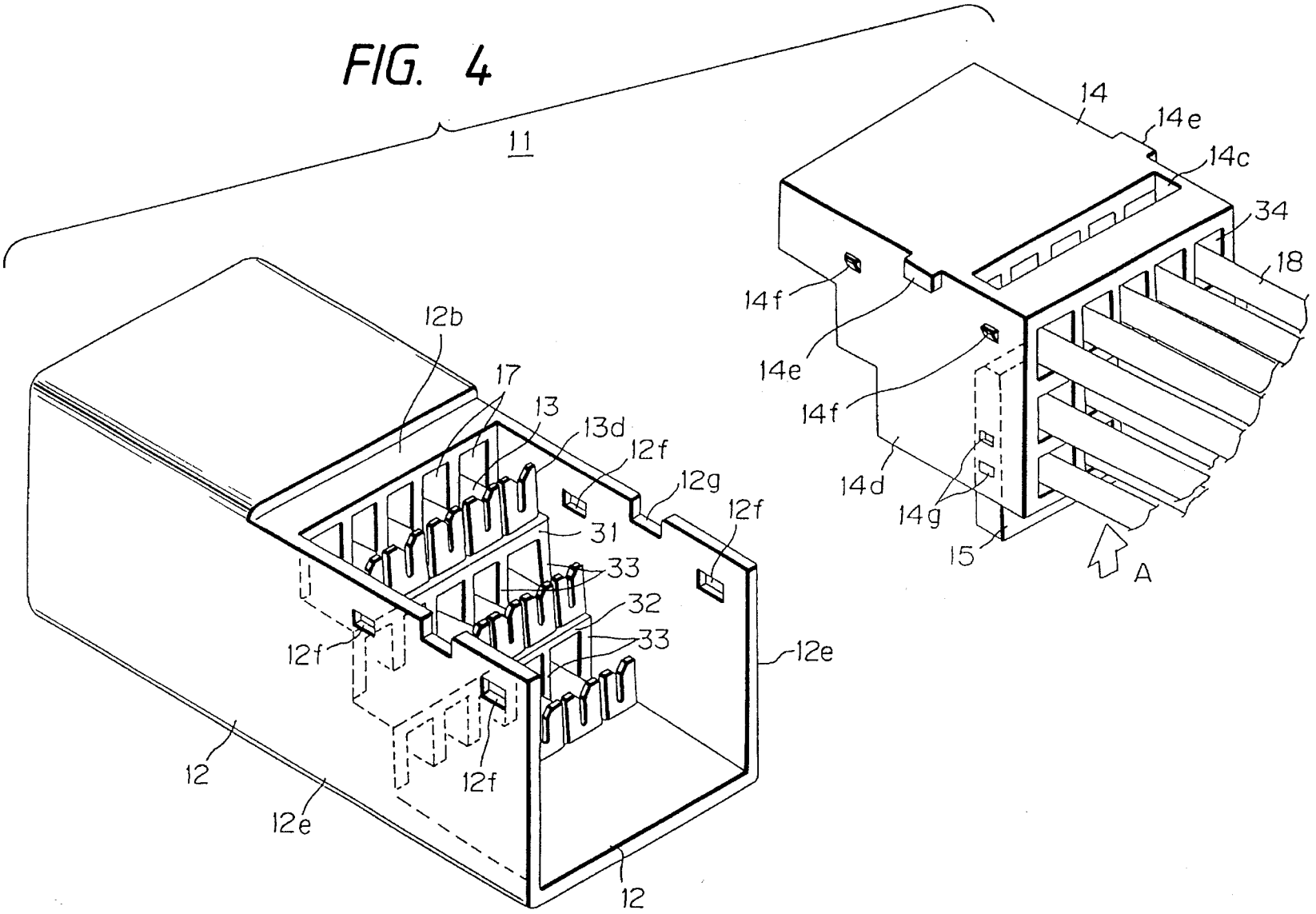
FIG. 4 is a perspective view of the multi-stage connector before it is assembled, showing a state in which pressure contact terminals are mounted to a housing main body.

Next, description will be given of the assembly of the connector 11. At first, as shown in FIG. 4, the pressure contact terminals 13 are completely stored into the terminal storage chambers 17 of the respective stages. That is, the pressure contact terminals 13 are inserted into the housing main body 12 in the following manner: the male tab 13*a* is inserted into the terminal insertion through hole 12*d* formed in the partition wall 12*a* from the rear side of the housing main body 12, the housing pressure insertion portions 13*b* are pressure inserted into the partition wall 12*a*, and the stoppers 13*c* are inserted until they are abutted against the partition wall 12, so that the leading ends of the respective tabs 13*a* can be lined in a co-planar fashion within the opening 16.

On the other hand, the wire holder 14 is set in such a manner that the spacer 15 is fitted into the spacer insertion portion 14*c* from the holder bottom surface 14*b* side of the wire holder 14. That is, in this stage, as shown in FIGS. 4 and 5, the wire insertion portions 34 of the wire holder 14 are in communication with the opening windows 15*a* of the spacer 15 in the middle and lower stages thereof and the upper edge portion 15*b* of the spacer 15 is exposed into the wire insertion portions 34 of the wire holder 14 in the upper stage. After the wires 18 are inserted until they are abutted against the vertical wall 35 in the wire insertion portions 34 of the wire holder 14 in the respective stages and rows, with this state being maintained, if the spacer 15 is pushed and further inserted in an upward direction shown by an arrow A in the FIGS. 4 and 5 until the lower edge portions of the spacer 15 provide a uniform surface with respect to the holder bottom surface 14*b* of the wire holder 14, then the spacer securing projections 15*e* are respectively secured into the securing holes 14*g* of the wire holder 14 so that the spacer 15 can be fixedly secured to the wire holder 14. As a result of this, the electric wires 18 are pushed upwardly by the upper edge portion 15*b* of the spacer 15 as well as by the bottom edge portions 15*c* of the opening windows 15*a* and, in the wire insertion portions 34, the wires 18 are pushed into the spacer insertion portion 14*c* forming a wire escape portion and are thus curved in part so that they are provisionally held by the wire holder 14.

The wire holder 14, which is provisionally holding the wires 18, is next used also as a cover member to close the upper surface opening of the housing main body 12 and is fitted between the two side walls 12*e* of the housing main body 12. In this operation, when the pressure contact edges 13*d* are respectively inserted into the wire holder 14 from the openings 14*h* formed in the wire holder 14, and the wire holder 14 is pushed in so that the leading ends of the pressure contact edges 13*d* are secured into the securing holes 34*a* of the wire insertion portions 34, then the wires 18 are pressure inserted into their respective pressure contact edges 13*d*, so that the pressure contact terminals 13 can be respectively connected with the wires 18. And, in this state, if the projections 14*e* of the wire holder 14 are fitted into the cutaway portions 12*g* of the housing main body 12, then the wire holder 14 is restricted in position in the longitudinal direction thereof and, at the same time, if the securing projections 14*f* of the wire holder 14 are engaged into the securing holes 12*f* of the housing main body 12, then the wire holder 14 can be mounted to the housing main body 12.

Figure 6:
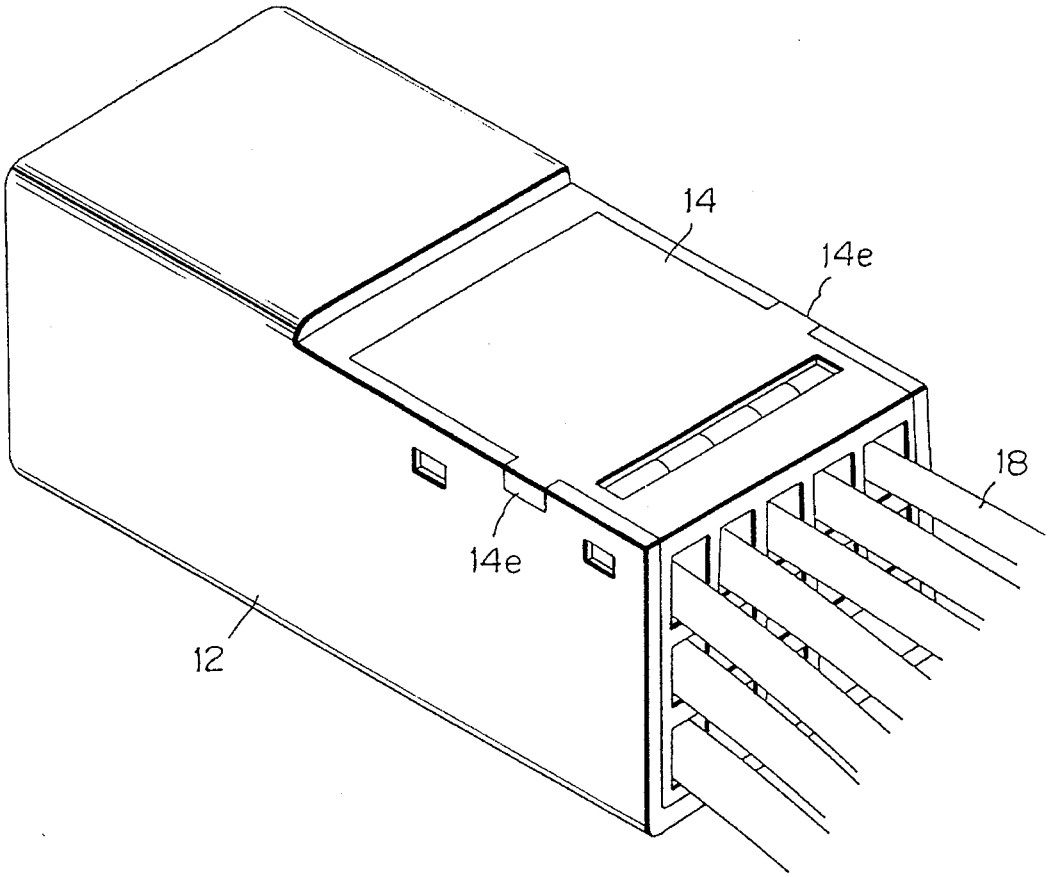
FIG. 6 is a perspective view of the connector shown in FIG. 1, showing a state in which the assembling of the connector is completed.

By assembling the connector in the above manner, as shown in FIGS. 1 and 6, the wire holder 14 is capable of pressure-inserting the electric wires 18 as a block into the pressure contact terminals 13 of the respective stages to connect the wires 18 with the terminals 13. Due to this, a cover mounting step and a wire connecting step can be executed at the same time in one operation, which makes it possible to reduce the time necessary for the connecting operation. At the same time, use of the wire holder 14 makes it possible to realize an easy wire handling operation.

Also, the spacer 15 cooperates with the wire holder 14 to bend the wires 18 to be held by the wire holder 14, thereby preventing the wires from being removed out of position. Essentially, in the assembled state of the spacer 15 to the housing main body 12, because the spacer 15 is always pushed by the upper surface of bottom plate 12*c* of the housing main body 12 and is thus stored into the spacer insertion portion 14*c*, the spacer 15 can realize a strain relief function firmly.

Next, description will be given below of a second embodiment of a connector according to the invention with reference to FIGS. 7 to 10. In the second embodiment, the same parts as those employed in the previously described first embodiment are given the same designations and the description thereof is omitted here.

In the second embodiment, a housing main body 12A forming a multi-stage connector 11A is structured substantially identical with the first embodiment but is different only in that a projection 36 projecting like a rib for pushing up wires is provided on the bottom plate 12*c*, specifically, in the portion thereof near to the end thereof. Therefore, terminals 13 are structured similarly to the first embodiment and are also to be stored into the terminal storage chambers 17.

Also, in the second embodiment, there are employed three separate wire holders 19, 20 and 21 which cooperate together in forming a three-part structure having a shape similar to the wire holder 14 shown in the first embodiment which is divided into the three stages. That is, the three wire holders consist of an upper stage holder 19, a middle stage holder 20 and a lower stage holder 21. The three holders are respectively fitted between two side plates 12*e* forming the housing main body 12A, and also are formed as small blocks which are put on top of another sequentially according to the stage-wise terminal storage chambers 17 of the housing main body 12A. Therefore, the respective holders 19, 20, and 21 are reduced in length sequentially in the order of the upper stage holder 19, middle stage holder 20, and lower stage holder 21.

Figure 8:
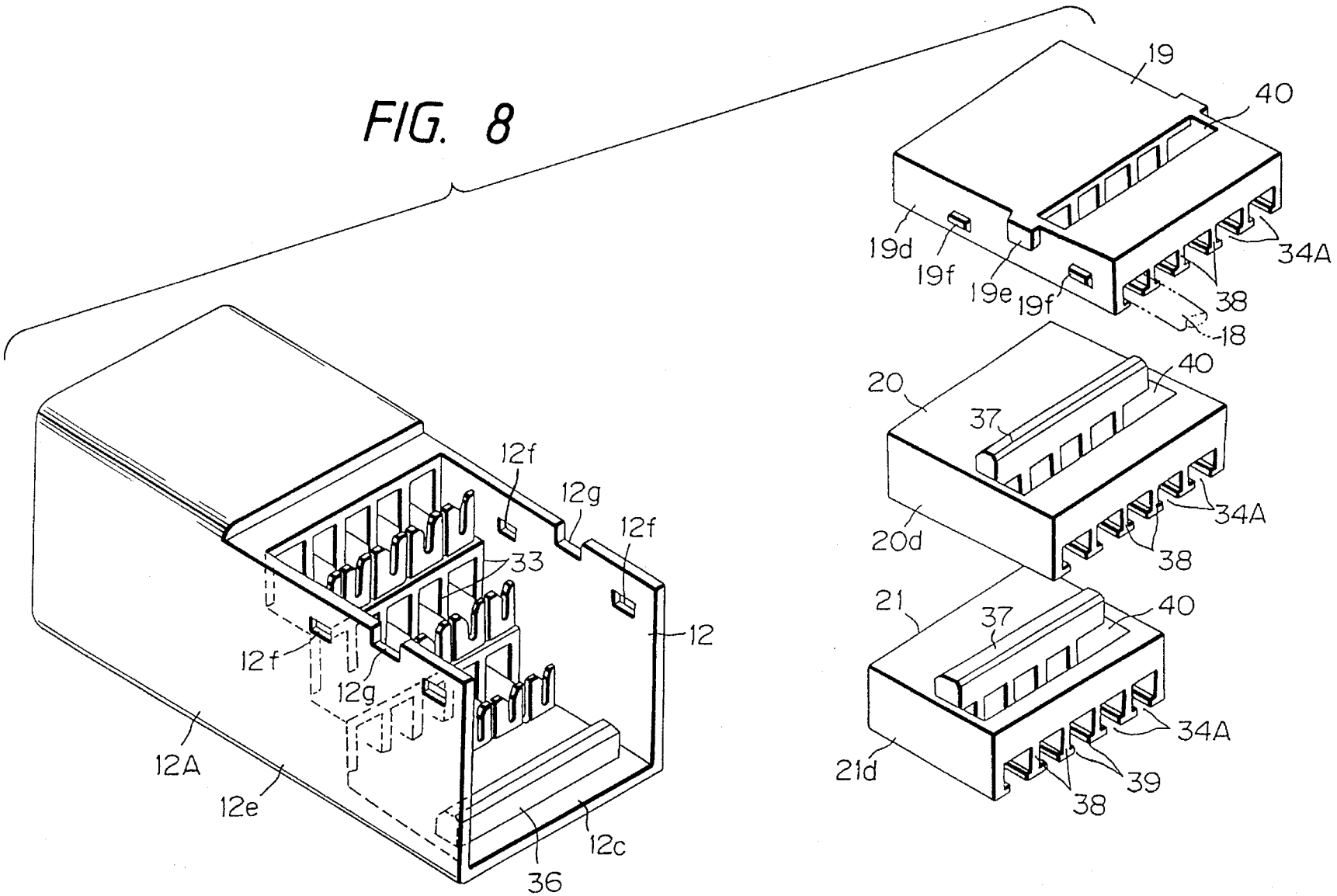
FIG. 8 is a perspective view of the multi-stage connector of FIG. 7 before it is assembled, showing a state in which pressure contact terminals are mounted to a housing main body.
Figure 9:
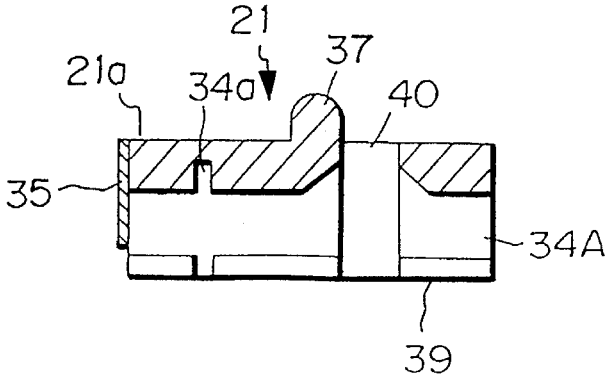
FIG. 9 is a longitudinal section view of one of wire holders employed in the connector shown in FIG. 7.
Figure 10:
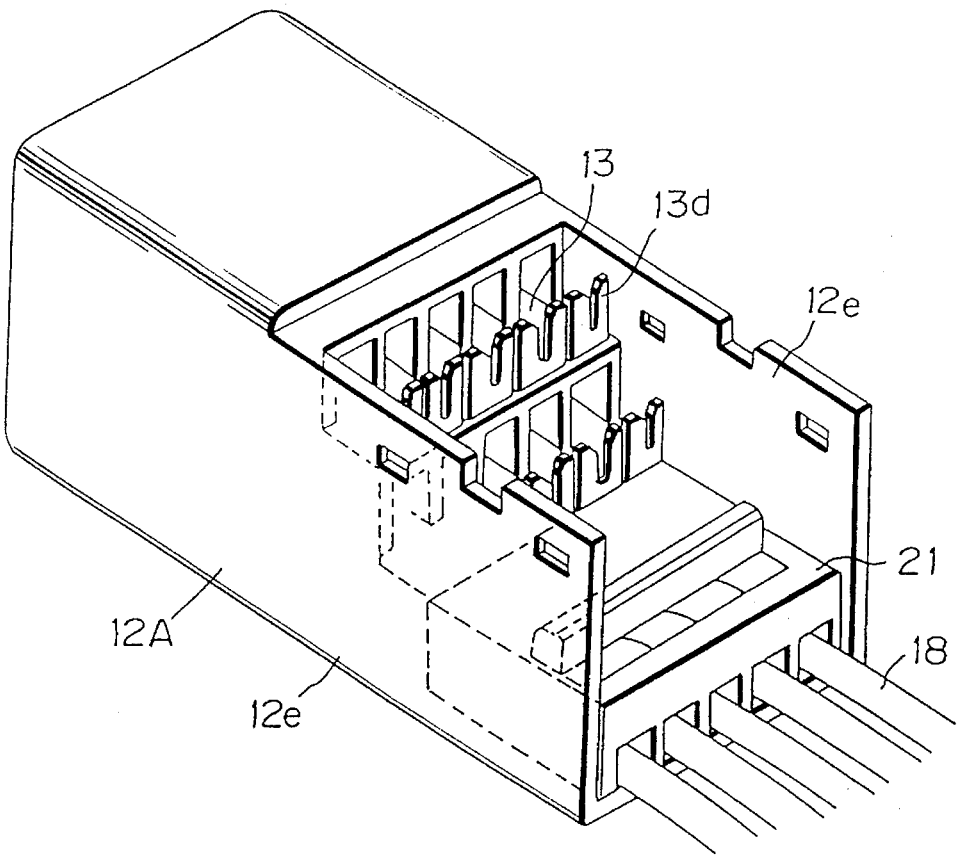
FIG. 10 is a perspective view of the wire holder of FIG. 9 and the wire holder, showing a state in which the wire holder is assembled to the lower stage of the housing main body.
Figure 11:
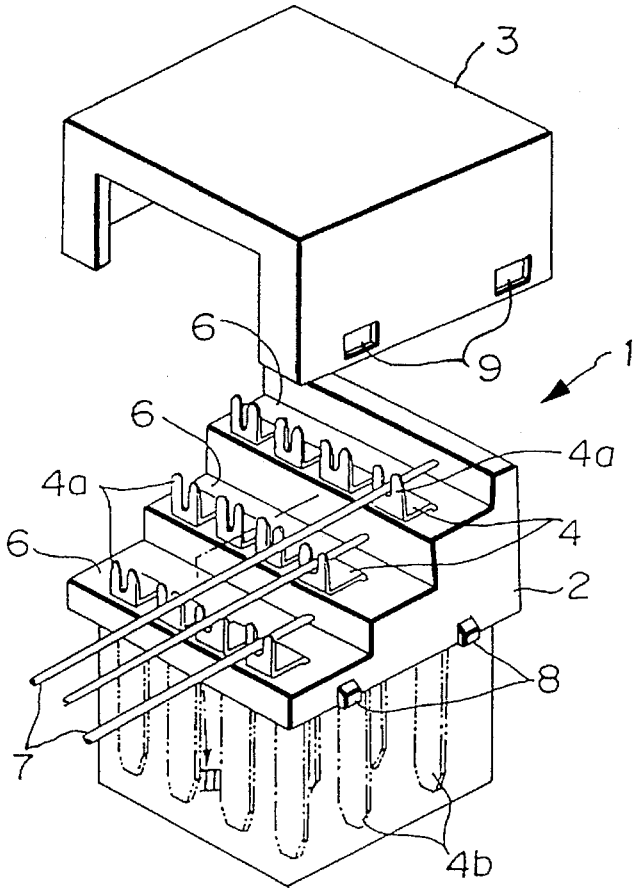
FIG. 11 is a perspective view of a conventional multi-stage connector.
Figure 12:
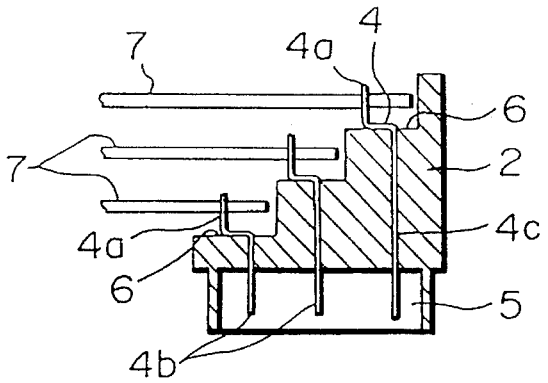
FIG. 12 is a section view of the conventional multi-stage connector.

In each of the three holders 19, 20, and 21, a plurality of wire insertion portions 34A are formed by partition walls 38 corresponding to partition members 33 which respectively form the terminal storage chambers 17. Referring further to the wire insertion portions 34A by way of the lower stage holder 21, as shown in FIGS. 8 and 9, each of the wire insertion portions 34A is opened in the bottom thereof, that is, the bottom plate of the wire insertion portion 34A is removed. However, in the lower end portions of the two side walls 19*d* and portion walls 38, there are adjoiningly provided securing stripes 39 which are bent so as to project slightly into the wire insertion portions 34A along the wire insertion portions 34A.

In the lower holder 21, there is formed a through opening 40 which serves as a wire escape portion, extends along the wire insertion portion 14A and has a shape similar to the spacer insertion portion 14*c* formed in the wire holder 14 according to the previously described first embodiment. That is, the lower holder 21 is structured in the following manner: when the lower holder 21 is assembled to the housing main body 12A, the wire pushing-up projection 36 of the housing main body 12A is provided at a position corresponding to the opening 40 so that it can be fitted into the opening 40.

Also, on the holder upper surface 21*a* corresponding to the front end of the opening 40, there is projected a wire pushing-up projection 37 identical in shape with the above-mentioned wire pushing-up projection 36 provided on the bottom plate 12*c*, and the wire pushing-up projection 37 can be fitted into an opening 40 to be formed similarly in the middle holder 20.

The upper stage holder 19 and middle stage holder 20 are respectively arranged such that the respective lengths thereof from the front end of the lower stage holder 21 to the opening 40 and the respective lengths thereof from the opening 40 to the rear end of the holder differ from each other sequentially. The wire pushing-up projection 37 provided in the middle stage holder 20 is arranged such that it can be fitted into the opening 40 formed in the upper stage holder 19. However, in the upper stage holder 19, there is not provided a projection which corresponds to the wire pushing-up projections 37 respectively provided in the lower stage holder 21 and middle stage holder 20. Instead, the upper stage holder 19 includes on the two side surfaces 19*d* thereof a projection 19*e* and two securing projections 19*f* which can be respectively engaged into a cutaway portion 12*g* and two securing holes 12*f* respectively formed in the housing main body 12A and thus can be mounted to the housing main body 12A at a given position thereof.

A vertical wall 35 serving as a wire stopper to close the wire insertion portion 34A in part is secured to the opening end face, which faces the terminal storage chambers 17, of each of the holders 19, 20 and 21. Also, on the upper end inner wall surface of the wire insertion portion 34A, there is formed a securing hole 34*a* into which can be secured the projecting leading end of the pressure contact edge 13*d* projected out from the terminal storage chamber 17.

The multi-stage connector 11A having the above structure is assembled substantially similarly to the connector described in the first embodiment. That is, the pressure contact terminals 13 are mounted into the housing main body 12A and, although not shown in FIG. 8, the electric wires 18 are inserted into the wire insertion portions 34A of the holders 19, 20, and 21, so that the holders 19, 20, and 21 hold the wires 18 provisionally. In this state, the wires 18 are provisionally held in such a manner that they are placed on the securing stripes 39 provided in the wire insertion portions 34A.

Figure 7:
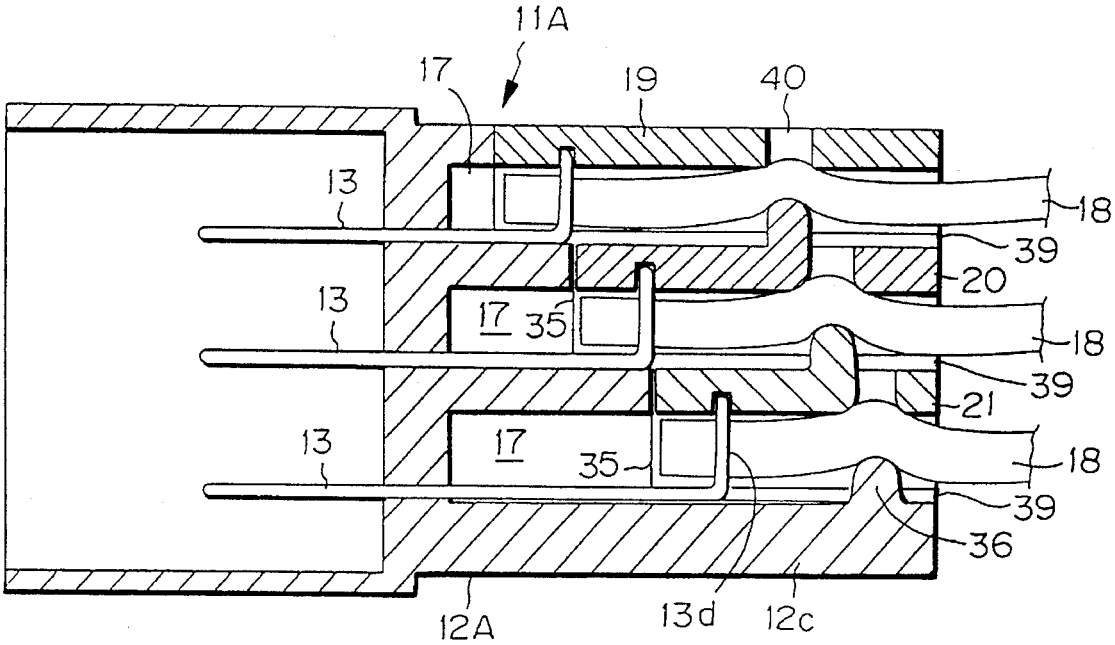
FIG. 7 is a section view of a multi-stage connector which is a second embodiment according to the invention.

After the holders 19, 20, and 21 hold the wires 18 provisionally, at first, the lower stage holder 21 is fitted between the two side walls 12*e* as a cover member to close the upper surface opening of the housing main body 12A. As shown in FIG. 7, the holder 21 is disposed in a manner to correspond to the terminal storage chamber 17 of the lower stage. In this operation, the pressure contact edges 13*d* of the pressure contact terminals are passed through the securing stripes 39 of the lower stage holder 21 and are allowed to go into the wire insertion portion 34A, and the lower stage holder 21 is pushed in so that the leading ends of the pressure contact edges 13*d* are engaged into the securing holes 34*a* of the wire insertion portions 34A. As a result, the wires 18 are pressure inserted into the pressure contact edges 13*d* due to the pressing force of the holder 21 and are then connected with the pressure contact terminals 13, respectively. At the same time, the wires 18 are pushed up so as to escape into the opening by the wire pushing-up projection 36. Thus, the wire 18 are partly bent in a curved manner by the entrance of the opening 40 and the inner wall surface of the wire insertion portion 34A.

Further, the wire pushing-up projection 36, due to its correspondence to the opening 40, can act also as a member to restrict the movements of the lower stage holder 21 in the back and forth direction with respect to the housing main body 12A.

Next, the middle stage holder 20 is superimposed on top of the lower stage holder 21, is mounted to the housing main body 12A similarly to the lower stage holder 21 and is positioned in such a manner that the wire pushing-up projection 37 of the lower holder 21 can correspond to the opening 40 formed in the middle stage holder 20. As a result of this, the wires 18 held provisionally by the middle stage holder 20 are connected to the pressure contact terminals 13 of the middle stage.

Finally, after the upper stage holder 19 is arranged so as to be superimposed on top of the middle stage holder 20 and the wires 18 are respectively connected to the pressure contact terminals 13 of the upper stage, the projection 19e of the upper stage holder 19 is fitted into the cutaway portion 12*g* of the housing main body 12, so that the upper stage holder 19 is restricted in position. At the same time, the two securing projections 19*f* are respectively engaged into the two securing holes 12*f* of the housing main body 12, so that the upper stage holder 19 is mounted to the housing main body 12.

As described above, according to the second embodiment of the invention, due to the fact that the wire holders 19, 20, and 21 acting as a wire holder and also as a cover member are used to connect the electric wires 18 to the pressure contact terminals of the respective stages, and also due to the fact that the wires 18 are bent in the respective holder mounting steps to thereby assemble the connector, a wire connecting operation can be simplified and also the wire holding force of the connector can be increased.

Although the respective embodiments of the invention have been described heretofore, the invention is not limited to the illustrated embodiments but various changes and modifications may be made in the invention without departing from the spirit and scope thereof. For example, the pressure contact terminal 13 may be of either a male type or a female type and the number of the pressure contact terminals 13 to be used can be changed according to specific cases.

Also, although in the illustrated embodiments there is disclosed a multi-stage connector, the present invention can also be applied to a one-stage connector structure which is generally used.

As has been described heretofore, according to the connector of the invention, since the operation to connect the wires to their respective pressure contact terminals and the operation to mount the wire holders each serving also as a cover member are executed in the same step (that is, since the wires can be connected to the pressure contact terminals simply by assembling the wire holders to the housing main body), simplicity in assembling the connector is improved, and mass production is easily achieved.

Also, the electric wires are previously held provisionally by the wire holders, or the wires are bent by means of the step of mounting the wire holders to the housing main body, so that the wires are firmly prevented from being removed backwardly.

What is claimed is:

1. A connector, in which a plurality of pressure contact terminals are stored, for connecting a partner connector with the pressure contact terminals in an electrically energizable manner, said connector comprising:

a housing main body for storing said pressure contact terminals in parallel to one another, said housing main body being opened in an upper surface thereof so as to expose said pressure contact terminals in part;

a wire holder including a plurality of wire receiving chambers for retaining a plurality of electric wires therein and also serving as a cover member to close said opened upper surface of said housing main body, said wires being received in said wire receiving chambers and extending in a first direction, said wire holder including a spacer insertion portion extending in a second direction perpendicular to said first direction; and a spacer including a plurality of wire receiving holes and being received in said spacer insertion portion, said spacer being movable from a provisionally retained position, at which said holes are respectively aligned with said wire receiving chambers such that said wires can be inserted therein, to a completely retained position, at which said holes are at least partially misaligned with said chambers thereby bending said wires in said second direction.

2. A connector as set forth in claim 1, wherein each of said pressure contact terminals includes an electric contact portion fittable with said partner connector and a pressure contact edge into which each of said wires is pressure inserted, and said pressure contact edge is bent-formed with respect to said electric contact portion in a manner to project toward said opened upper surface of said housing main body.

3. A connector as set forth in claim 1, wherein said wire holder includes a wire escape portion for receiving at least some of said bent wires.

4. A connector, in which a plurality of pressure contact terminals are stored, for connecting a partner connector with the pressure contact terminals in an electrically energizable manner, said connector comprising:

a housing main body for storing said pressure contact terminals in parallel to one another, said housing main body being opened in an upper surface thereof so as to at least partially expose said pressure contact terminals;

a wire holder, securable to said housing main body, capable of holding a plurality of electric wires provisionally and also serving as a cover member to close said opened upper surface of said housing main body, said wire holder having wire chambers in which said wires are received extending in a first direction;

a bending means cooperable with said wire holder to bend said wires in a second direction perpendicular to said first direction, wherein said wire holder is secured to said housing main body to thereby be able to pressure-insert said wires into respective said pressure contact terminals, wherein said bending means includes a plurality of bending projections which are respectively fixedly secured to said housing main body and said wire holder.

5. A connector as set forth in claim 4, wherein said housing main body is formed as a multi-stage structure in which a plurality of pressure contact terminals are arranged on top of one another and the rear end portions of respective stages of said housing main body are respectively formed in a stepped shape in order to be able to expose the respective pressure contact edges of said pressure contact terminals in said stages.

6. A connector as set forth in claim 4, wherein said wire holder comprises a plurality of wire holder layers stacked one on top of another, said wire holder layers being of different lengths with each of said wire holder layers being shorter than a wire holder layer immediately above.

7. A connector as set forth in claim 4, wherein said wire holder includes wire escape portions for receiving a bent portion of said wires.

8. A connector as set forth in claim 7, wherein said bending projections are provided in opposition to said wire escape portions.

9. A connector, in which a plurality of pressure contact terminals are stored, for connecting a partner connector with the pressure contact terminals in an electrically energizable manner, said connector comprising:

a housing main body for storing said pressure contact terminals in parallel to one another, said housing main body being opened in an upper surface thereof so as to at least partially expose said pressure contact terminals;

a plurality of wire holders stackable on one another and securable to said housing main body, said wire holders each having wire receiving chambers for respectively holding a plurality of electric wires and also serving as a cover member to close said opened upper surface of said housing main body, at least one having a projection for bending said wires, at least partially outwardly of said wire receiving chambers;

wherein said wire holder is secured to said housing main body to thereby be able to pressure-insert said wires into respective said pressure contact terminals.

* * * * *